US008432352B2

(12) United States Patent
Lee

(10) Patent No.: US 8,432,352 B2
(45) Date of Patent: Apr. 30, 2013

(54) BACKLIGHT DRIVING CIRCUIT AND DRIVING METHOD FOR DRIVING THE SAME

(75) Inventor: Tae Wook Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 877 days.

(21) Appl. No.: 12/336,027

(22) Filed: Dec. 16, 2008

(65) Prior Publication Data

US 2009/0273558 A1 Nov. 5, 2009

(30) Foreign Application Priority Data

May 2, 2008 (KR) ..... 10-2008-0041290

(51) Int. Cl.
*G09G 3/36* (2006.01)

(52) U.S. Cl.
USPC ..... 345/102

(58) Field of Classification Search ..... None
See application file for complete search history.

(56) References Cited

U.S. PATENT DOCUMENTS

| | | | | |
|---|---|---|---|---|
| 6,249,547 | B1 * | 6/2001 | Boyce et al. | 375/240.15 |
| 6,271,809 | B1 * | 8/2001 | Kim | 345/60 |
| 6,278,428 | B1 * | 8/2001 | Smith et al. | 345/92 |
| 7,061,544 | B1 * | 6/2006 | Nonomura et al. | 348/568 |
| 7,505,016 | B2 * | 3/2009 | Kwon | 345/87 |
| 2005/0104837 | A1 | 5/2005 | Baik et al. | |
| 2007/0152926 | A1 | 7/2007 | Kwon | |
| 2007/0285382 | A1 | 12/2007 | Feng | |
| 2009/0140665 | A1 * | 6/2009 | Park | 315/291 |

FOREIGN PATENT DOCUMENTS

| | | | |
|---|---|---|---|
| JP | 3-125333 | U | 12/1991 |
| JP | 06-160811 | | 6/1994 |
| JP | 2002-031846 | | 1/2002 |
| JP | 2005-338857 | | 12/2005 |
| JP | 2007183608 | A | 7/2007 |
| KR | 1020070070915 | A | 7/2007 |
| KR | 1020070105351 | A | 10/2007 |
| WO | 2007/046320 | A1 | 4/2007 |

OTHER PUBLICATIONS

Office Action issued in corresponding European Patent Application No. 08 01 9872; issued Mar. 36, 2010.
Office Action issued in corresponding Japanese Patent Application No. 2008-319510, mailed Oct. 26, 2011.
Office Action issued in corresponding Korean Patent Application No. 10-2008-0041290, mailed Sep. 13, 2012.

* cited by examiner

*Primary Examiner* — K. Wong
(74) *Attorney, Agent, or Firm* — Brinks Hofer Gilson & Lione

(57) ABSTRACT

A backlight driving circuit and a method for driving the same, which are capable of preventing a flicker phenomenon and delay of response, are disclosed. The backlight driving circuit includes a selective filtering unit for comparing dimming signals currently supplied for a current frame with dimming signals previously stored for a previous frame, to determine how abruptly an image of the current frame has varied from an image of the previous frame, and outputting the dimming signals for the current frame after modulating duty ratios of the dimming signals for the current frame selectively.

15 Claims, 14 Drawing Sheets

| | | | |
|---|---|---|---|
| DM1 (98) | DM2 (126) | DM3 (89) | DM4 (21) |
| DM5 (110) | DM6 (162) | DM7 (166) | DM8 (22) |
| DM9 (120) | DM10 (98) | DM11 (169) | DM12 (162) |
| DM13 (91) | DM14 (75) | DM15 (135) | DM16 (170) |

Previous Frame

| | | | |
|---|---|---|---|
| DM1 (100) | DM2 (150) | DM3 (90) | DM4 (20) |
| DM5 (120) | DM6 (152) | DM7 (165) | DM8 (22) |
| DM9 (92) | DM10 (88) | DM11 (170) | DM12 (160) |
| DM13 (85) | DM14 (75) | DM15 (136) | DM16 (172) |

Current Frame

FIG. 8A

Step 1 :

$D = |Ave_{m,n}(N) - Ave_{m,n}(N-1)|$

D(DM1)= |100-98| = 2
D(DM2)= |150-126| = 24
D(DM3)= |90-89| = 1
D(DM4)= |20-21| = 1
D(DM5)= |120-110| = 10
D(DM6)= |152-162| = 10
D(DM7)= |165-166| = 1
D(DM8)= |22-22| = 0
D(DM9)= |92-120| = 28
D(DM10)= |88-98| = 10
D(DM11)= |170-169| = 1
D(DM12)= |160-162| = 2
D(DM13)= |85-91| = 6
D(DM14)= |75-75| = 0
D(DM15)= |136-135| = 1
D(DM16)= |172-170| = 2

FIG. 8B

Step 2 :

If |D| > Threshold1(100) then count=count+1

Else count = count

Count = 0

FIG. 8C

Step 3 :

If count > Threshold2(12) then MAF_On_Off = 1

Else MAF_On_Off = 0

MAF_On_Off = 1

| | | | |
|---|---|---|---|
| DM1 (0) | DM2 (0) | DM3 (0) | DM4 (0) |
| DM5 (0) | DM6 (0) | DM7 (0) | DM8 (0) |
| DM9 (0) | DM10 (0) | DM11 (0) | DM12 (0) |
| DM13 (0) | DM14 (0) | DM15 (0) | DM16 (0) |

Previous Frame

FIG. 9B

| | | | |
|---|---|---|---|
| | | | |
| | | | |
| | | | |
| | | | |
| DM1 (255) | DM2 (255) | DM3 (255) | DM4 (255) |
| DM5 (255) | DM6 (255) | DM7 (255) | DM8 (255) |
| DM9 (255) | DM10 (255) | DM11 (255) | DM12 (255) |
| DM13 (255) | DM14 (255) | DM15 (255) | DM16 (255) |

Current Frame

FIG. 10A

Step 1 :

$D = |Ave_{m,n}(N) - Ave_{m,n}(N-1)|$

D(DM1)=|255-0| = 255
D(DM2)= |255-0| = 255
D(DM3)=|255-0| = 255
D(DM4)=|255-0| = 255
D(DM5)=|255-0| = 255
D(DM6)=|255-0| = 255
D(DM7)=|255-0| = 255
D(DM8)=|255-0| = 255
D(DM9)=|255-0| = 255
D(DM10)=|255-0|= 255
D(DM11)=|255-0|= 255
D(DM12)=|255-0|= 255
D(DM13)=|255-0|= 255
D(DM14)=|255-0|= 255
D(DM15)=|255-0|= 255
D(DM16)=|255-0|= 255

FIG. 10B

Step 2 :

If |D| > Threshold1(100) then count=count+1

Else count = count

Count = 16

FIG. 10C

Step 3 :

If count > Threshold2(12) then MAF_On_Off = 1

Else MAF_On_Off = 0

MAF_On_Off = 0

BACKLIGHT DRIVING CIRCUIT AND DRIVING METHOD FOR DRIVING THE SAME

RELATED APPLICATIONS

This application claims the benefit of the Korean Patent Application No. 10-2008-0004129, filed on May 2, 2008 which is hereby incorporated by reference as if fully set forth herein.

BACKGROUND

1. Technical Field

The present invention relates to a backlight driving circuit, and more particularly, to a backlight driving circuit and a method for driving the same, which are capable of preventing a flicker phenomenon and delay of response.

2. Related Art

A liquid crystal display (LCD) device displays an image by controlling light transmittance values of liquid crystal cells in accordance with a video signal. An active matrix LCD device is advantageous in displaying a moving image because a switching element is provided for each pixel cell. For the switching element, a thin film transistor (TFT) is mainly used.

Such an LCD device includes a plurality of gate lines and a plurality of data lines which intersect each other. The LCD device also includes a plurality of pixels formed in corresponding pixel regions defined by the gate lines and data lines.

The LCD device may provide an active image effect by modulating data, as well as by modulating the luminance of backlight in accordance with the characteristics of the data. However, the luminance of backlight may abruptly increase or decrease when the data amount between neighboring frames large. Where such frames, which exhibit a large amount of data difference, are successively generated screen flickers may occur.

BRIEF SUMMARY

Accordingly, the present invention is directed to a backlight driving circuit and a method for driving the same that substantially obviate one or more problems due to limitations and disadvantages of the related art.

An object of the present invention is to provide a backlight driving circuit and a method for driving the same, which are capable of preventing a flicker phenomenon, and achieving a high response rate coping with an abrupt image variation by performing an image comparison for every frame, to determine image characteristics, and controlling whether or not a filter unit should operate, based on the result of the determination.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

By way of example, in one embodiment, a backlight driving apparatus comprises: an average data generating unit for dividing a display area of a display panel into a plurality of display regions, and calculating an average value of data supplied to each display region, thereby generating an average data value corresponding to each display region; a dimming signal generating unit for generating a dimming signal having a duty ratio based on the average data value; and a selective filtering unit for comparing the dimming signals currently supplied for a current frame with the dimming signals previously stored for a previous frame, to determine how abruptly an image of a current frame has varied from an image of a previous frame. The selective filtering unit outputs the dimming signal for the current frame after modulating the duty ratio of the dimming signal for the current frame. The selective filtering unit may forgo modulating the duty ratio of the dimming signal.

In another embodiment, a method for driving a backlight driving circuit comprises: A) dividing a display area of a display panel into n ("n" is a natural number of 2 or more) display regions, and generating n average data values by calculating an average value of data supplied to each of the display regions, ; B) generating n dimming signals each having a duty ratio based on the average data value of the corresponding display region; and C) determining image variation between a current frame and a previous frame by comparing the dimming signals currently supplied for the current frame with the dimming signals previously stored for a previous frame and outputting the dimming signals for the current frame after selectively modulating duty ratios of the dimming signals for the current frame. In yet another embodiment, the method for driving the backlight driving circuit further comprises forgoing modulating the duty ratios of the dimming signals, The backlight driving apparatus and driving method performs an image comparison for every frame, to determine the characteristics of an image of the frame, and controls whether the filtering unit should operate, based on the result of the image comparison. Accordingly, a flicker phenomenon may be prevented and a high response rate even in an abrupt image variation may be obtained.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings:

FIG. 6 is a block diagram illustrating a second embodiment of a backlight driving circuit according to;

FIGS. 8A to 8C are flow charts for explaining an operation sequence of a selective filtering unit for an image, for example, images shown in FIGS. 7A and 7B;

FIGS. 9A and 9B are views illustrating image variation displayed on the display area when data variation between neighboring frames is large; and FIGS. 10A to 10C are flow charts for explaining an operation sequence of a selective filtering unit for an image, for example, images shown in FIGS. 9A and 9B.

DETAILED DESCRIPTION OF THE DRAWINGS AND THE PRESENTLY PREFERRED EMBODIMENTS

Reference will now be made in detail to the preferred embodiments, examples of which are illustrated in the accompanying drawings.

Figure 1:
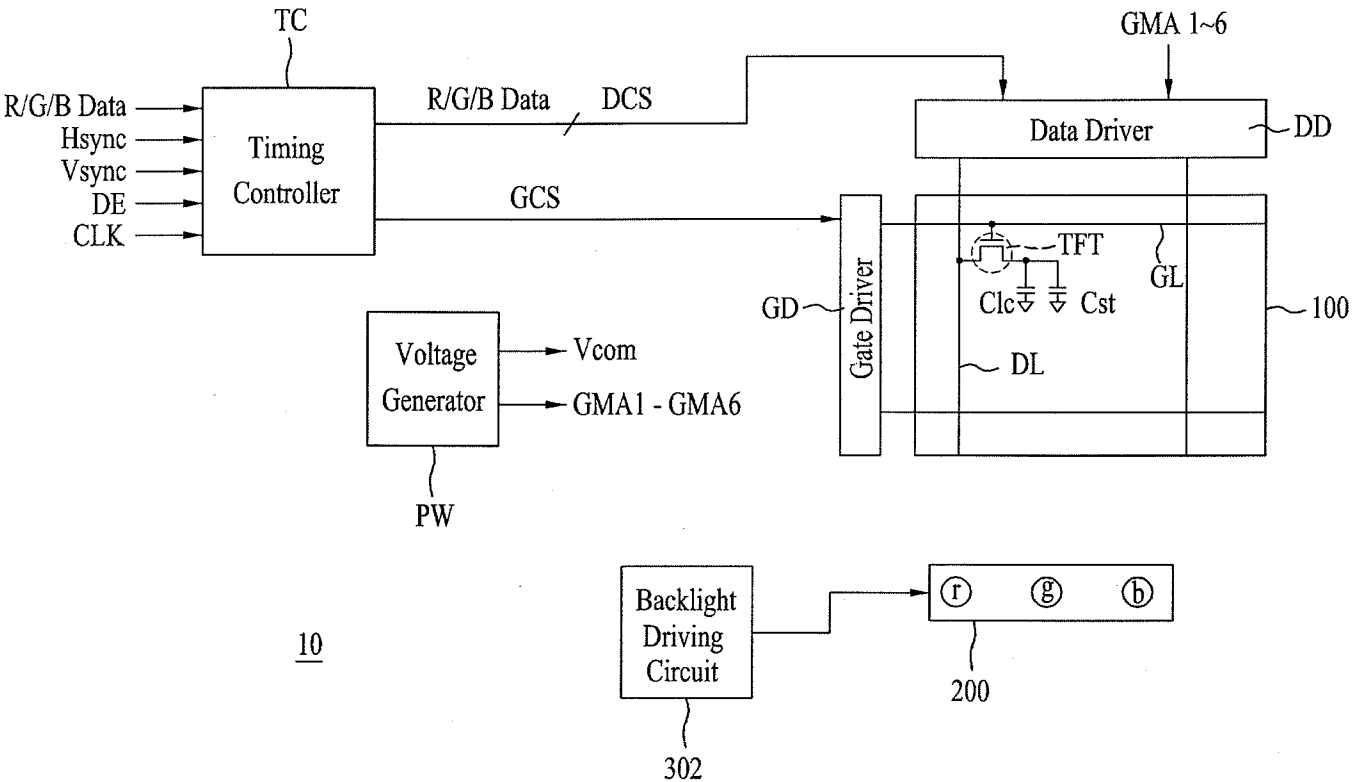
FIG. 1 is a block diagram illustrating a liquid crystal display (LCD) device.
Figure 2:
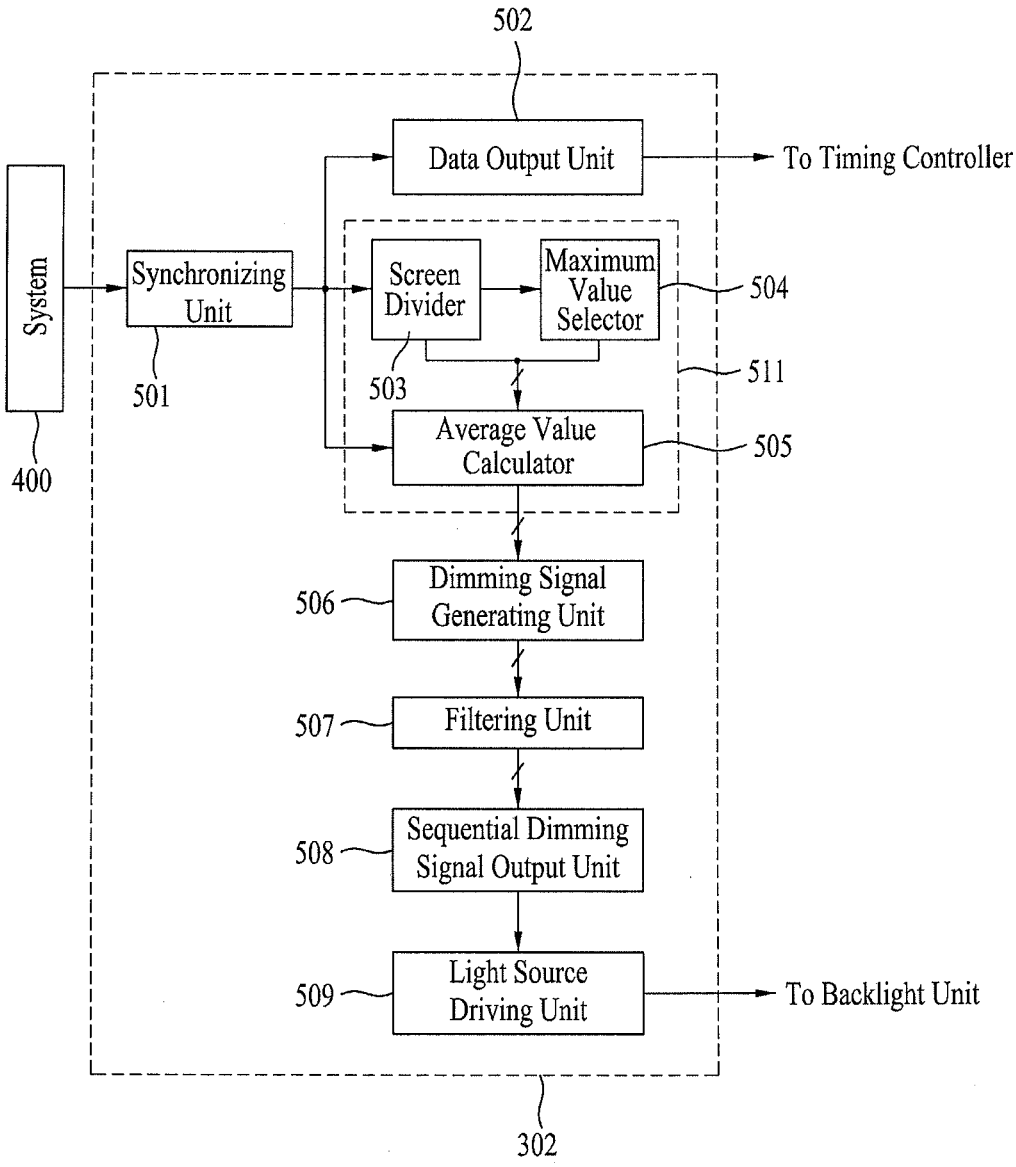
FIG. 2 is a block diagram illustrating a first embodiment of a backlight driver.
Figure 11:
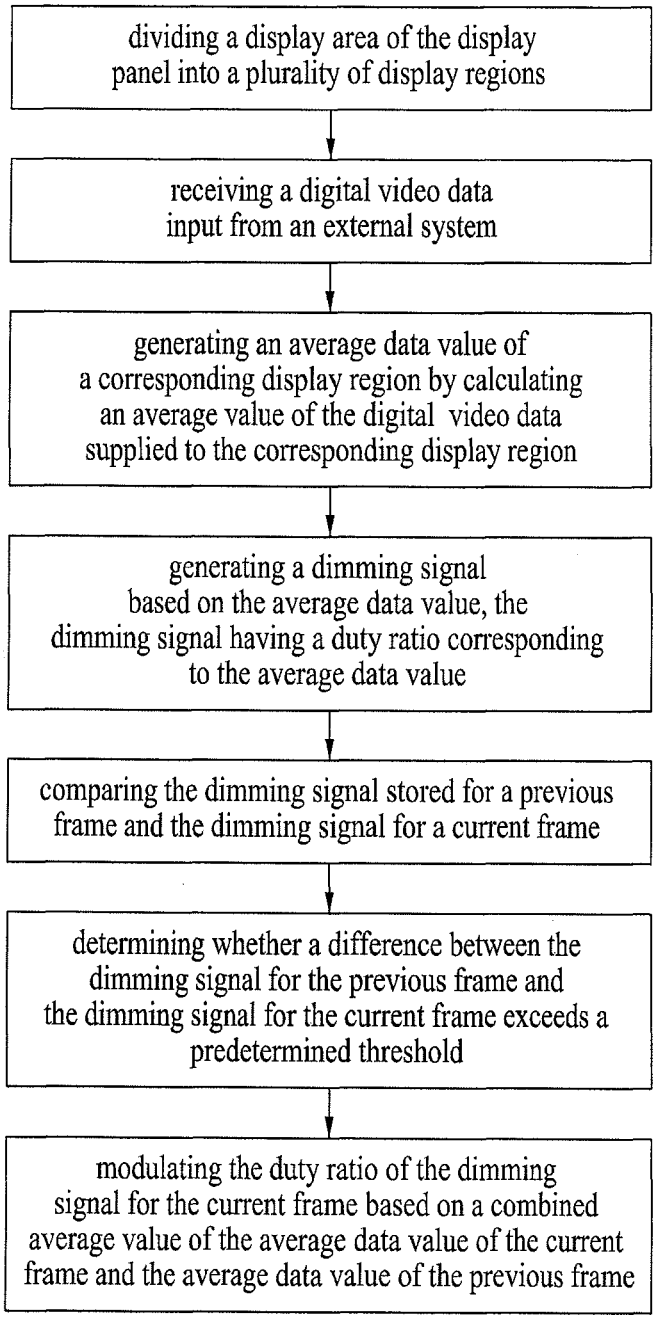
FIGS. 11 and 12 are flow charts illustrating the operation sequence of the first and the second embodiments shown in FIGS. 2 and 6.

FIG. 1 is a block diagram illustrating one embodiment of a liquid crystal display (LCD) device 10. FIG. 2 is a block diagram illustrating a first embodiment of a backlight driver. FIG. 11 is a flow chart illustrating the operation sequence of the first embodiments shown in FIG. 2

As shown in FIG. 1, the LCD device 10 includes a display panel 100, which includes gate lines GL, data lines DL intersecting with the gate lines GL, and thin film transistors (TFTs) formed at respective intersections of the gate lines GL and data lines DL. The LCD device 10 also includes a data driver DD for inputting data to the data lines DL of the display panel 100, a gate driver GD for inputting scan pulses to the gate lines GL of the display panel, a backlight unit 200 including a plurality of light sources r, g, and b to irradiate light to the display panel 100, a backlight driving circuit 302 for driving the light sources r, g, and b of the backlight unit 200, and a timing controller TC for controlling the data driver DD, gate driver GD of the display panel 100 and a backlight drawing circuit 302.

The light sources r, g, and b are light emitting diodes (LEDs), and include a plurality of red light sources r for emitting red light, a plurality of green light sources g for emitting green light, and a plurality of blue light sources g for emitting blue light. White light is generated in accordance with a combination of red light from the red light sources r, green light from the green light sources g, and blue light from the blue light sources g.

Figure 3:
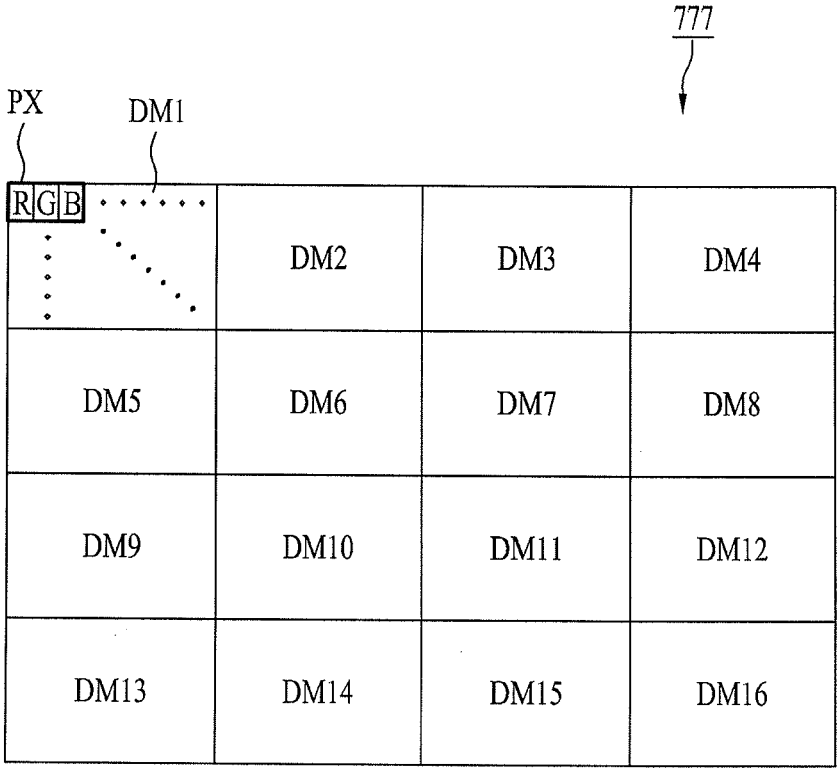
FIG. 3 is a schematic view illustrating a display area shown in FIG. 2.

As shown in FIG. 3, the display panel 100 includes a plurality of unit pixels PX each adapted to display a unit image. Each unit pixel PX includes a red pixel R for displaying a red image, a green pixel G for displaying a green image, and a blue pixel B for displaying a blue image.

Each of the pixels R, G, and B includes a TFT for switching data from the corresponding data line DL in response to a scan pulse from the corresponding gate line GL, and a liquid crystal cell for displaying an image in accordance with the switched data from the TFT. The TFT includes a source electrode connected to the corresponding data line DL, a drain electrode connected to a pixel electrode of the corresponding liquid crystal cell, and a gate electrode connected to the corresponding gate line GL. The display panel 100 includes a color filter array substrate and a TFT array substrate, which are assembled to each other under the condition in which a liquid crystal layer is interposed between the color filter array substrate and the TFT array substrate. Color filters and common electrodes are formed on the color filter array substrate. Each color filter includes red, green, and blue color filter layers each functioning to allow light of a specific wavelength to pass therethrough, and thus to achieve color display. A black matrix is formed between adjacent color filter layers of different colors.

Each liquid crystal cell includes a liquid crystal capacitor for sustaining data for one frame period, and an auxiliary capacitor for stably sustaining the data for the frame period of the data.

Referring back to FIG. 1, the timing controller TC rearranges digital video data input from a system via the backlight driving circuit 302 into red (R) data, green (G) data, and blue (B) data. The R data, G data, and B data re-arranged by the timing controller TC are input to the data driver DD.

The timing controller TC generates a data control signal DCS and a gate control signal GCS, using a horizontal synchronizing signal Hsync, a vertical synchronizing signal Vsync, and a clock signal CLK, and supplies the generated signals DCS and GCS to the data driver DD and gate driver GD, respectively. The data control signal DCS includes a dot clock, a source shift clock, a source enable signal, a polarity inverting signal, etc. The gate control signal GCS includes a gate start pulse, a gate shift clock, a gate output enable signal, etc.

The data driver DD samples the data input thereto in accordance with the data control signal DCS from the timing controller TC, latches the sampled data at every horizontal time 1H, 2H, . . . in an amount corresponding to one line, and supplies the latched data to the data lines DL. The data driver DD converts the R/G/B data supplied from the timing controller TC into analog pixel signals, using gamma voltages GMA1 to GMA6, and supplies the analog pixel signals to the data lines DL.

The gate driver GD includes a shift register for generating a scan pulse in a sequential manner in response to the gate start pulse included in the gate control signal GCS supplied from the timing controller TC, and a level shifter for shifting the voltage of the generated scan pulse to a voltage level suitable for the driving of the liquid crystal cells. The gate driver GD supplies a gate-high voltage to the gate lines GL in a sequential manner in response to the gate control signal GCS.

A voltage generator PW supplies a common electrode voltage Vcom to the display panel 100, and supplies gamma voltages GMA1 to GMA6 to the data driver DD.

As shown in FIG. 2, the backlight driving circuit 302 includes a synchronizer 501, a data output unit 502, an average data generating unit 511, a dimming signal generating unit 506, a filtering unit 507, a sequential dimming signal output unit 508, and a light source driving unit 509.

The synchronizing unit 501 supplies RIG/B data input from a system 400 to the data output unit 502 and average data generating unit 511 in synchronization with a clock signal. The data output unit 502 supplies the R/G/B data to the timing controller TC in synchronization with the clock signal.

The average data generating unit 511 divides a display area 777 of the display panel 100 into n ("n" is a natural number of 2 or more) display regions DM1 to DMn, as shown in FIG. 8. In other words, display regions DM1 to DMn may be arbitrarily defined from the display area 777 of the display panel 100 to calculate and determine an average value of the data supplied to each display region. In FIG. 3, n is, for instance, 16. The average data generating unit 511 calculates an average value of data supplied to each of the display regions DM1 to DM16, and thus generate n average data pieces. That is, the display panel 100 includes a plurality of pixels R, G, and B, and a display area 777, on which an image is displayed by the pixels R, G, and B. The average data generating unit 511 calculates an average value of data supplied to the pixels R, G, and B in each of the display regions DM1 to DM16, and thus generates n average data pieces for respective display regions DM1 to DM16.

To this end, the average data generating unit 511 includes a screen divider 503, a maximum value selector 504, and an average value calculator 505. The screen divider 503 analyzes R/G/B data supplied from the system 400 via the synchronizing unit 501, and divides the display area 777 into the n display regions. For example, the screen divider 503 may divide the display area 777 into 16 display regions DM1 to DM16, as shown in FIG. 3. For convenience of explanation, n is 16 in this embodiment.

The maximum value selector 504 selects data having a maximum value from among R data supplied to the red pixel R, G data supplied to the green pixel G, and B data supplied to the blue pixel B in each unit pixel PX of an arbitrary display region. One display region includes a plurality of unit pixels PX, and each unit pixel PX includes one red pixel R, one green pixel G, and one blue pixel B, as shown in FIG. 3. The maximum value selector 504 selects one pixel receiving data having a maximum value from among three pixels R, G, and B of each unit pixel PX, and extracts the data value of the selected pixel from the unit pixel PX.

The average value calculator 505 calculates an average value from the sum of the data values extracted from the maximum value selector 504 for each display region, to calculate average data for the display region.

The average data generating unit 511 calculates and generates average data for all display regions DM1 to DM16 in the above-described manner. Thus, the number of average data values provided from the average data generating unit 511 is equal to the number of the display regions.

The dimming signal generating unit 506 receives each average data from the average value calculator 505, and generates a dimming signal for the average data. The dimming signal generating unit 506 generates a dimming signal having a duty ratio corresponding to the value of each average data. The number of dimming signals output from the dimming signal generating unit 506 is equal to the number of display regions.

The filtering unit 507 re-adjusts the duty ratios of dimming signals output corresponding to the current frame to be displayed, based on the value of data of the current frame and the values of data of several previous frames displayed in the corresponding previous frame periods. To this end, the filtering unit 507 again sets the average data value of each display region in the current frame to the average value obtained from the sum of the average data value of the display region in the current frame and the average data value of the display region in each previous frame corresponding to the current frame. Thus, the duty ratio of each dimming signal is again set based on the corresponding re-set average data value.

The sequential dimming signal output unit 508 sequentially outputs the dimming signals from the filtering unit 507 to the light source driving unit 509. The light source driving unit 509 generates pulsewidth modulation signals, based on the dimming signals from the sequential dimming signal output unit 508. The pulsewidth modulation signals are supplied to the light sources r, g, and b, such that the light sources r, g, and b emit light.

Figure 4:
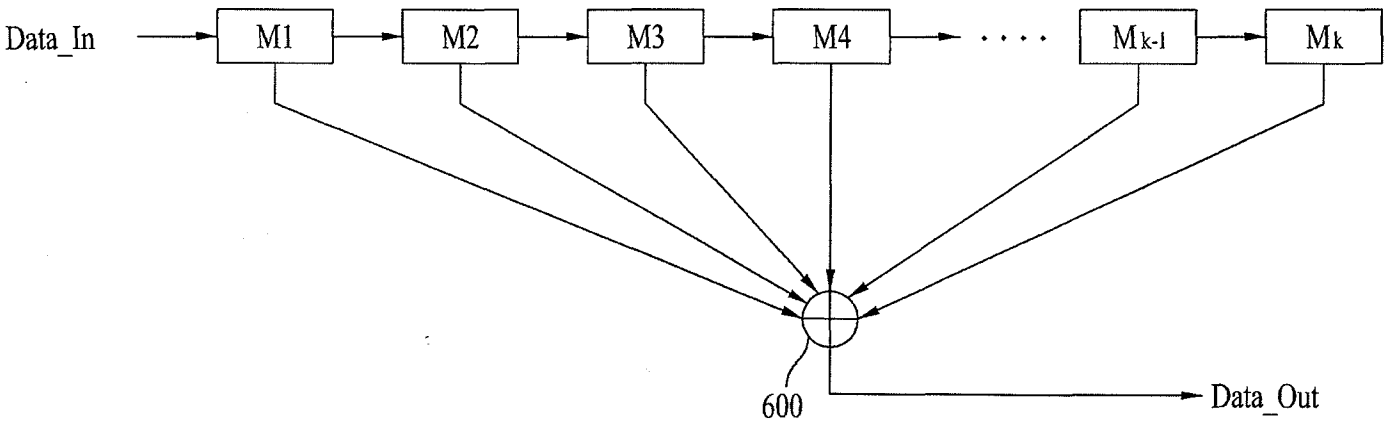
FIG. 4 is a block diagram for explaining the configuration and operation of a filtering unit.

The operation of the filtering unit 507 will be described in more detail with reference to FIG. 4. FIG. 4 is a block diagram for explaining the configuration and operation of the filtering unit 507. The filtering unit 507 is a moving average filter, and includes a plurality of line memories M1 to Mk, and a summing unit 600. Each of the line memories M1 to Mk shifts data previously stored therein to the memory arranged adjacent to the right side thereof every time data is input thereto. In FIG. 4, k line memories M1 to Mk are shown. The data of the current frame is supplied to the first line memory M1, which is arranged at a leftmost position among the line memories M1 to Mk. In the second to k-th line memories M2 to Mk, data values of previous frames are sequentially stored, respectively. The data of the current frame and the data of the previous frames are average data values.

The data value of the current frame stored in the first line memory M1 and the data values of the previous frames respectively stored in the second to k-th line memories M2 to Mk are summed and then averaged by the summing unit 600. The averaged data value, namely, modulated data, is used as a source for a dimming signal which will be used for the driving of the light sources r, g, and b during the current frame period. Namely, the dimming signal has a duty ratio based on the averaged data value. Thus, it is possible to eliminate a flicker phenomenon, which may occur when the data value difference between neighboring frames is severe, or when the data of the current frame is distorted due to noise, etc. such that it has an increased value.

The filtering unit 507 is provided to correspond to the number of display regions. For example, where the number of display regions is 16, the number of filtering units 507 is 16. In this embodiment the filtering units 507 are referred to as first to 16-th filtering units 507.The first filtering unit 507 calculates an average value from the sum of respective data values during the first to k-th frame periods for the first display region DM1. The second filtering unit 507 calculates an average value from the sum of respective data values during the first to k-th frame periods for the second display region DM2. In the same manner, the remaining filtering units 507 calculate average values for the corresponding display regions, respectively. For example, the 16-th filtering unit 507 calculates an average value from the sum of respective data values during the first to k-th frame periods for the 16-th display region DM 16.

Figure 5:
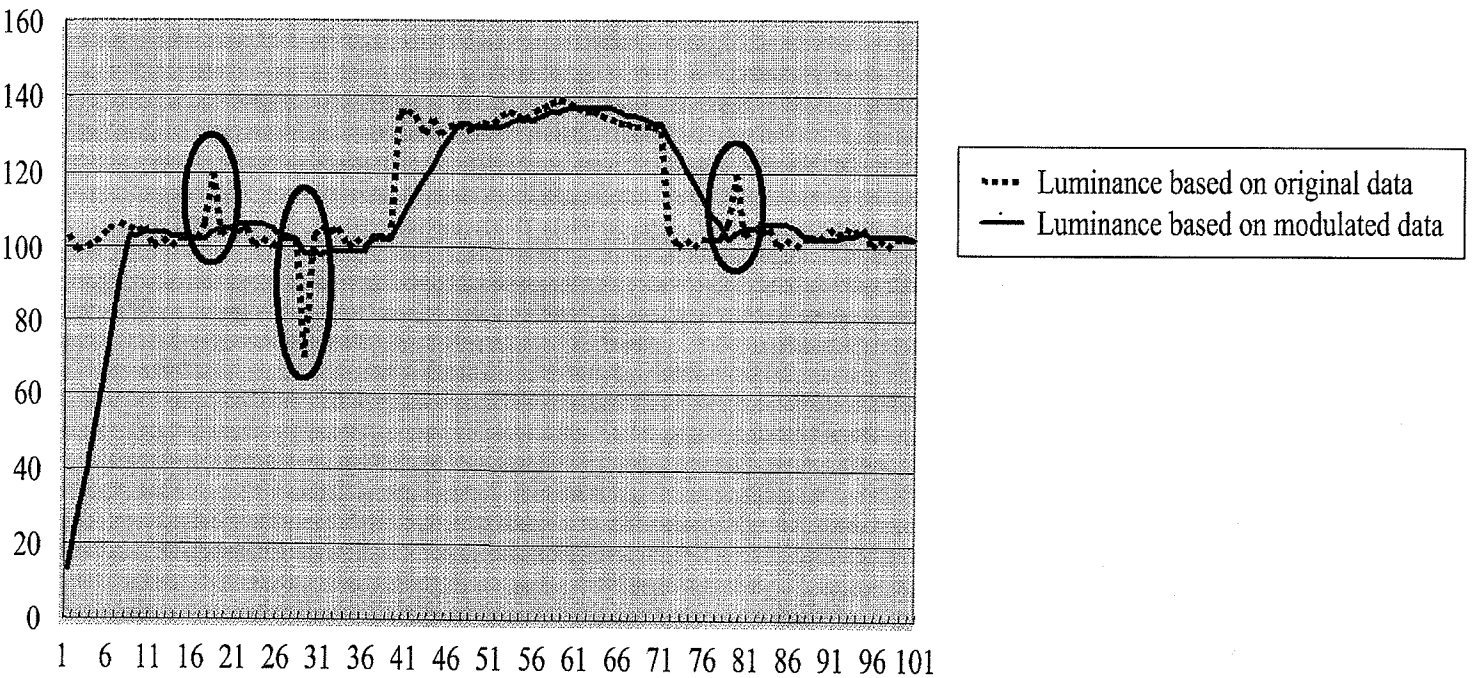
FIG. 5 is a graph for explaining the results of comparison between the luminance of light generated based on original data and the luminance of light generated based on modulated data.

In another embodiment, the display area 777 may have a single display region. In this case, only one filtering unit 507 is needed. FIG. 5 is a graph for explaining the results of comparison between the luminance of light generated based on the original data and the luminance of light generated based on the modulated data. As shown in FIG. 5, the light generated based on the original data may abruptly vary at one moment in a specific frame period. However, the light generated based on the modulated data exhibits a luminance almost equal to those in previous frame periods. Accordingly, flickers phenomenon may be substantially reduced.

Figure 6:
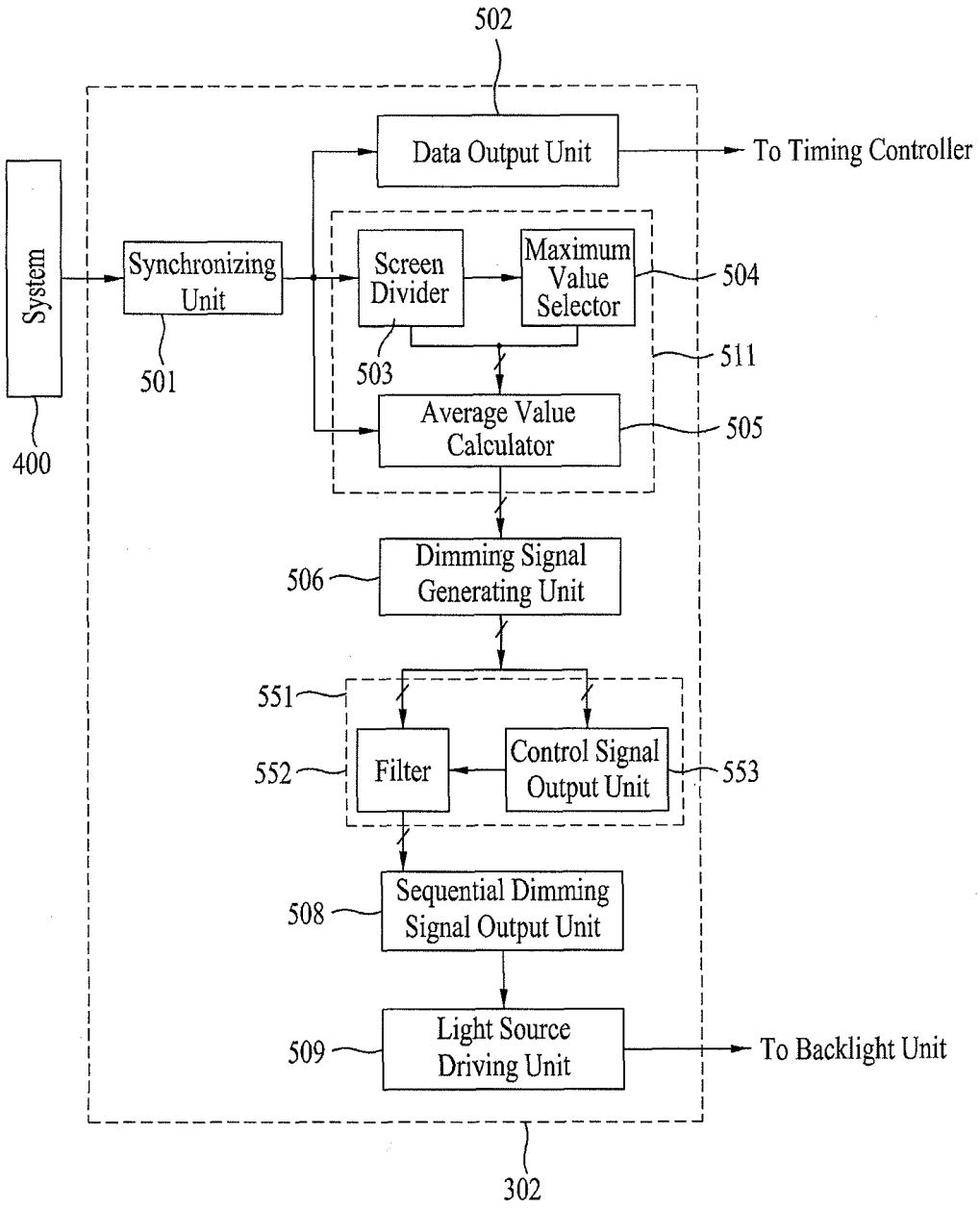
Figure 12:
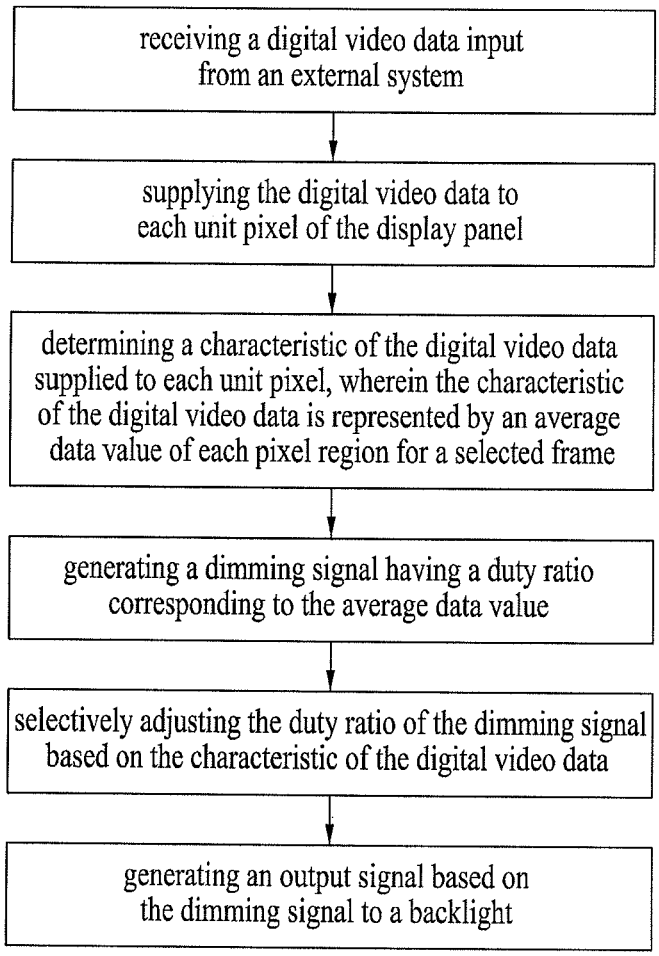

FIG. 6 is a block diagram illustrating a second embodiment of a backlight driving circuit 302. FIG. 12 is a flow chart illustrating the operation sequence of the first and the second embodiments shown in FIG. 6.

As shown in FIG. 6, the backlight driving circuit 302 includes the synchronizer 501, the data output unit 502, an average data generating unit 511, the dimming signal generating unit 506, a selective filtering unit 551, the sequential dimming signal output unit 508, and the light source driving unit 509.

The backlight driving circuit 302 further includes a control signal output unit 553 which is installed in the selective filtering unit 551. The synchronizer 501, data output unit 502, average data generating unit 511, dimming signal generating unit 506, sequential dimming signal output unit 508, and light source driving unit 509 are described in conjunction with FIG. 2 above.

The selective filtering unit 551 receives the dimming signals of the previous and current frames, performs an average data comparison for each display region in every frame, and calculates an average data difference for each display region. The average data difference is compared with a predetermined reference grayscale value. Based on the results of the comparison for all display regions, the selective filtering unit 551 determines the number of display regions each having an average data difference exceeding the predetermined reference grayscale value. Based on the results of the determination, the selective filtering unit 551 again sets the average data value of each display region in the current frame to the average value obtained from the sum of the average data value of the display region in the current frame and the average data value of the display region in each previous frame corresponding to the current frame. Thus, the duty ratio of each dimming signal to be generated from the dimming signal generating unit 506 is again set, based on the corresponding re-set average data value. In this case, a modulated dimming signal for each display region is output. Otherwise, the selective filtering unit 551 outputs the dimming signals from the dimming signal generating unit 506 without a modulation.

To this end, the selective filtering unit 551 includes a control signal output unit 553 and a filter 552.

The control signal output unit 553 receives the dimming signals of the previous and current frames, performs an average data comparison for each display region in every frame, and calculates an average data difference for each display region. The control signal output unit 553 then compares the average data difference with the predetermined reference grayscale value. Based on the results of the comparison for all display regions, the control signal output unit 553 determines the number of display regions each having an average difference exceeding the predetermined reference grayscale value. Based on the results of the determination, the control signal output unit 553 outputs a first control signal or a second control signal.

In detail, the control signal output unit 553 outputs the first control signal when the determined number is larger than a predetermined threshold value. On the other hand, the control signal output unit 553 outputs the second control signal when the determined number is equal to or smaller than the predetermined threshold value.

The filter 552 receives the first and second control signals from the control signal output unit 553, and receives the dimming signals from the dimming signal generating unit 506. When the first control signal is supplied from the control signal output unit 553, the filter 552 modulates the average data value of each display region in the current frame into the average value obtained from the sum of the average data value of the display region in the current frame and the average data values of the display region in several previous frames corresponding to the current frame. Thus, the duty ratio of each dimming signal is again set, based on the corresponding modulated average data value. On the other hand, when the second control signal is supplied from the control signal output unit 553, the filter 552 outputs the dimming signals from the dimming signal generating unit 506 without a modulation.

The operation of the selective filtering unit 551 will be described in more detail with reference to FIGS. 7A to 10.

Figure 7A:
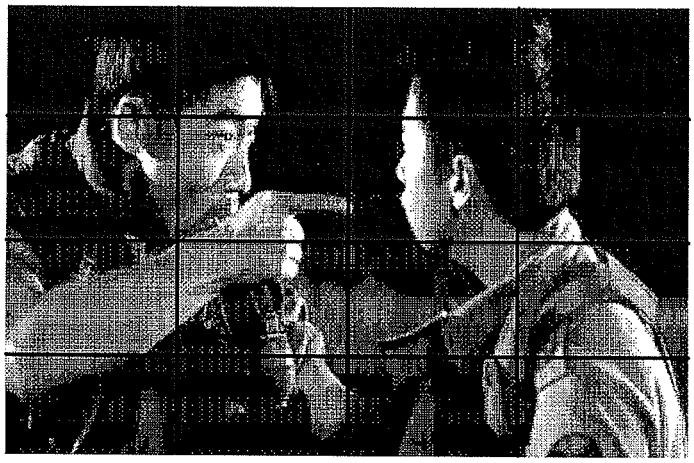
FIGS. 7A and 7B are views illustrating image variation displayed on the display area when data variation between neighboring frames is small.
Figure 7B:
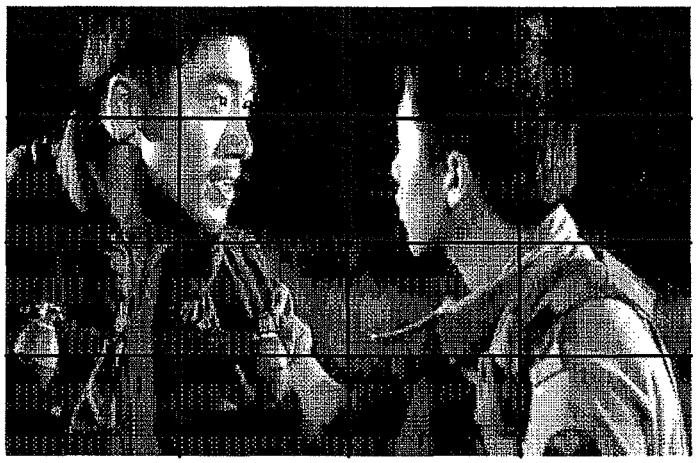

FIGS. 7A and 7B are views illustrating a variation in the image displayed on the display area 777 when the data variation between neighboring frames is small. FIGS. 8A to 8C are flow charts for explaining an operation sequence of the selective filtering unit 507 for an image, for example, images shown in FIGS. 7A and 7B.

As shown in FIGS. 7A and 7B, the screen divider 503 first divides the display area 777 into a plurality of display regions DM1 to DM16. The screen divider 503 then re-arranges R data, G data, and B data of one frame supplied from the system 400 via the synchronizing unit 501 for the divided display regions DM1 to DM16. Thereafter, the screen divider 503 supplies information about the display regions DM1 to DM16, and information about the data positioned in each of the display regions DM1 to DM16 to the maximum value selector 504 and average value calculator 505.

The maximum value selector 504 extracts data having a maximum value from each unit pixel PX in each of the display regions DM1 to DM16. That is, one display region includes a plurality of unit pixels PX. Accordingly, the maximum value selector 504 selects data having a maximum value from among data supplied to three pixels R, G, and B of each unit pixel PX. The maximum value selector 504 then supplies the selected data, which has the maximum value, to the average value calculator 505.

The average value calculator 505 sums the selected maximum data values for all unit pixels in each of the display regions DM1 to DM16, and divides the summed value by the number of display regions DM1 to DM16, thereby generating average data for the display region.

In FIGS. 7A and 7B, respective average data values of the display regions DM1 to DM16 are indicated within parenthesis. At a higher average data value, a brighter image is displayed. FIG. 7A is a view illustrating average data in each display region for a previous frame image. FIG. 7B is a view illustrating average data in each display region for a current frame image.

The average data of each display region is converted into a dimming signal while passing through the dimming signal generating unit 506. The dimming signal is supplied to the filter 552 and control signal output unit 553.

The control signal output unit 553 compares the dimming signals current supplied thereto for the current frame with the dimming signals previously stored therein for the previous frame, thereby determining how abruptly the image of the current frame has varied from the image of the previous frame. "$Ave_{m,n}(N)$" means average data in an arbitrary display region in an N-th frame, namely, the current frame, and "$Ave_{m,n}(N-1)$" means average data in an arbitrary display region in an N−1-th frame, namely, the previous frame.

To this end, as shown in FIG. 8A, the control signal output unit 553 derives an average data value difference D between the previous and current frames for each display region. This value is an absolute value, and represents how much the image of each display region has varied in every frame.

Thereafter, as shown in FIG. 8B, the derived average data value difference D is compared with a predetermined reference grayscale value Threshold 1.

The reference grayscale value may be one of grayscale values for data, or may be any other values. The reference grayscale value may be varied in accordance with the setting of the system 400. In an example according to the present invention, the reference grayscale value was set to "100".

As shown in FIG. 8B, the control signal output unit 553 compares, one by one, the difference values D of the display regions with the reference grayscale value. More specifically, the control signal output unit 553 compares 16 difference values D with the reference grayscale value, respectively. In accordance with the results of the comparison, the difference value D of an arbitrary display region may be smaller than the reference grayscale value, or may be larger than or equal to the reference grayscale value.

The control signal output unit 553 counts the number of display regions each exhibiting a difference value D larger than the reference grayscale value, and then compares the counted number with a predetermined threshold value Threshold2.

The threshold value Threshold2 may be any values. This value may vary in accordance with the setting of the system 400. By way of example only, the threshold value Threshold2 is set to "12".

The counted number may be larger, smaller than, or equal to the threshold Value Threshold2. When the counted number is smaller than or equal to the threshold value threshold2, the control signal output unit 553 outputs the second control signal to operate the filter 552. On the other hand, when the counted number is larger than the threshold value threshold2, the control signal output unit 553 outputs the first control signal to turn off the filter 552.

Referring to FIG. 8A, all difference values D of the display regions DM1 to DM16 are smaller than the reference grayscale value. In this case, the counted number count is "0", as shown in FIG. 8B. This means that the number of display regions each having a difference value larger than "100" does not exceed "12" as shown in FIGS. 7A and 7B. In FIG. 8C, "MAF_ON_OFF=1" means that the filter 552 is turned off in accordance with the second control signal.

Based on the above-described determination, the control signal output unit 553 outputs the second control signal, which is supplied to the filter 552.

In response to the second control signal, the filter 552 forgoes resetting the duty ratios of the 16 dimming signals supplied thereto.

Figure 9A:
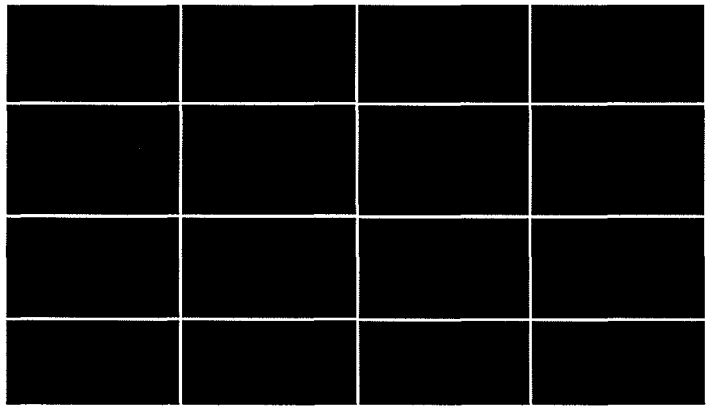

FIGS. 9A and 9B are views illustrating a variation in the image displayed on the display area 777 when the data variation between neighboring frames is large. FIGS. 10A to 10C are flow charts for explaining an operation sequence of the selective filtering unit 507 for an image, for example, images shown in FIGS. 9A and 9B.

Referring to FIG. 9A, the difference values of all display regions are larger than the reference grayscale value. FIGS. 9A and 9B illustrate an example exhibiting a variation from a black image to a white image. In this case, the counted number count is "16", as shown in FIG. 9B. Thus, in the images of FIGS. 9A and 9B and 10A and 10B, the number of display regions each having a difference value larger than "100" exceeds "12".

Based on the above-described determination, the control signal output unit 553 outputs the first control signal, which is supplied to the filter 552.

In response to the first control signal, the filter 552 resets outputs the 16 dimming signals supplied thereto without again setting the dimming signals. The filter 552 sums the average data of one display region in the current frame and the average data of the one display region in several previous frames corresponding to the current frame, and calculates an average value from the sum, to derive modulated average data. In this manner, the filter 507 derives modulated average data values for 16 display regions DM1 to DM16, respectively. Based on the modulated average data values, the filter 507 then again sets respective duty ratios of the 16 dimming signals supplied thereto. In other words, the filter 552 outputs the dimming signals of the current frame after again setting the duty ratios of the dimming signals. In FIG. 10C, "MAF_ON_OFF=0" means that the filter 552 is in operation in accordance with the first control signal.

As described above, the backlight driving unit in the second embodiment performs an image comparison for every frame, to determine the characteristics of an image of the frame, rather than operating the filtering unit for every frame. The backlight driving unit controls whether the filtering unit should operate based on the result of the image comparison. Accordingly, a flicker phenomenon a high response rate may be obtained even in an abrupt image variation. The LCD device 10 may respond in real time to the abrupt data variation between frames.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A method for driving a backlight driving unit for use with a display device comprising a display panel, comprising:

dividing a display area of the display panel into a plurality of display regions;

receiving a digital video data input from an external system;

generating an average data value of a corresponding display region by calculating an average value of the digital video data supplied to the corresponding display region;

generating a dimming signal based on the average data value, the dimming signal having a duty ratio corresponding to the average data value;

comparing the dimming signal stored for a previous frame and the dimming signal for a current frame;

determining whether a difference between the dimming signal for the previous frame and the dimming signal for the current frame exceeds a predetermined threshold; and modulating the duty ratio of the dimming signal for the current frame based on a combined average value of the average data value of the current frame and the average data value of the previous frame.

upon determination that the difference does not exceed the predetermined threshold, forgoing modulation of the duty ratio of the dimming signal for the current frame.

2. The method of claim 1, further comprising:

generating a first control signal when the difference exceeds the predetermined threshold; and wherein modulating the duty ratio comprises modulating the duty ratio in response to the first control signal.

3. The method of claim 1, further comprising:

generating a second control signal when the difference exceeds the predetermined threshold; and forgoing modulating the duty ratio of the dimming signal in response to the second control signal.

4. The method of claim 1, further comprising:

determining a count indicating a number of display regions having the difference that exceeds the predetermined threshold; and comparing the count with an additional threshold.

5. The method of claim 4, further comprising:

upon determination that the count exceeds the additional threshold, forgoing modulation of the duty ratio of the dimming signal.

6. The method of claim 1, further comprising:

sequentially outputting the dimming signal;

generating a pulse-width modulation signal based on the dimming signal; and supplying the pulse-width modulation signal to a backlight.

7. A method for driving a backlight for use with a display device comprising a display panel, comprising:

receiving a digital video data input from an external system;

supplying the digital video data to each unit pixel of the display panel;

determining a characteristic of the digital video data supplied to each unit pixel, wherein the characteristic of the digital video data is represented by an average data value of each pixel region for a selected frame;

generating a dimming signal having a duty ratio corresponding to the average data value;

selectively adjusting the duty ratio of the dimming signal based on the characteristic of the digital video data; and generating an output signal based on the dimming signal to a backlight.

wherein selectively adjusting the duty ratio comprises forgoing adjusting the duty ratio of the dimming signal when the characteristic of the digital video data indicates a level of image varation higher than a predetermined threshold level;

wherein determining the characteristics of the digital video data comprises:

comparing the average data value of the selected frame and the average data value of a previous frame of the selected frame; and determining whether a difference of the average data value in the selected frame and the previous frame exceeds a predetermined threshold level whereby the difference of the average data value represents a level of image variation between the selected frame and the previous frame.

8. The method of claim 7, further comprising:

providing the digital video data input to a timing controller.

9. The method of claim 7, further comprising:

selecting a pixel of the unit pixel that receives data of maximum value;

extracting the data value of the selected pixel; and generating the average data value based on a sum of the extracted data value.

10. A backlight driving system for use with a display device comprising a display panel, the backlight driving circuit comprising:

an input unit operable to receive a digital video input data;

an average value generating unit operable to receive the digital video input data and generate an average value of data supplied to a plurality of display regions of the display panel;

a dimming signal generating unit operable to receive the average value and generate a dimming signal representative of a duty ratio corresponding to the average value; and a filtering unit coupled to the dimming signal generating unit and operable to adjust the duty ratio of the dimming signal based on the average value of a current frame and a previous frame of the current frame;

a control unit coupled to the filtering unit and operable to generate a control signal that turns on or off the filtering unit;

wherein the control unit is further operable to compare the average value of data in a selected frame and the average value of data in a previous frame of the selected frame and to determine whether a difference in the average value of data exceeds a predetermined threshold wherein the predetermined threshold comprises a reference grayscale value.

11. The system of claim 10, wherein the control unit is operable to generate a first control signal upon determination that the difference does not exceed the predetermined threshold and the filtering unit is operable to adjust the duty ratio in response to the first control signal.

12. The system of claim 10, wherein the control unit is operable to generate a second control signal upon determination that the difference exceeds the predetermined threshold and the filtering unit is turned off in response to the second control signal.

13. The system of claim 10, wherein the control unit is operable to generate a second control signal upon determination that the difference exceeds the predetermined threshold and the filtering unit operates to forgo the adjustment of the duty ratio in response to the second control signal.

14. The system of claim 10, further comprising:

an output unit coupled to the filtering unit and operable to sequentially output the dimming signal; and a modulator operable to receive the dimming signal from the output unit and generate a pulse-width modulation signal based on the dimming signal.

15. The system of claim 10, wherein the average value generating unit further comprises:

a screen divider operable to identify the plurality of display regions of the display panel;

a maximum value selector coupled to the screen divider and operable to extract a maximum data value of a selected unit pixel in a display region wherein the selected unit pixel comprise a red pixel, a green pixel and a blue pixel; and an average value calculator coupled to the maximum value selector and operable to generate the average value of data based on a sum of the extracted maximum data value.

* * * * *

UNITED STATES PATENT AND TRADEMARK OFFICE

CERTIFICATE OF CORRECTION

PATENT NO. : 8,432,352 B2
APPLICATION NO. : 12/336027
DATED : April 30, 2013
INVENTOR(S) : Lee It is certified that error appears in the above-identified patent and that said Letters Patent is hereby corrected as shown below:

In the Claims

Column 10, claim 1, line 38, after "that the difference" replace "does not exceed" with --exceeds--.

Column 10, claim 2, line 43, before "the predetermined" replace "exceeds" with --does not exceed--.

Signed and Sealed this
Twenty-fourth Day of June, 2014

Michelle K. Lee

Michelle K. Lee
*Deputy Director of the United States Patent and Trademark Office*